United States Patent [19]

Fehrenbach et al.

[11] 4,064,854

[45] Dec. 27, 1977

[54] AIR VALVE FOR A FUEL INJECTION SYSTEM

[75] Inventors: Siegfried Fehrenbach, Markgroningen; Alfred Feuerbacher, Schwieberdingen, both of Germany

[73] Assignee: Robert Bosch GmbH, Stuttgart, Germany

[21] Appl. No.: 737,934

[22] Filed: Nov. 2, 1976

[30] Foreign Application Priority Data

Nov. 15, 1975 Germany ..... 2551340

[51] Int. Cl.[2] ..... F02M 69/00; F02M 39/00; F02M 7/00

[52] U.S. Cl. ..... 123/139 AW; 123/179 L; 123/179 G; 123/124 R; 261/50 A

[58] Field of Search ..... 123/139 AW, 179 L, 179 G; 261/50 A, 124 R

[56] References Cited

U.S. PATENT DOCUMENTS

| | | | |
|---|---|---|---|
| 2,851,026 | 9/1958 | Dahl et al. | 123/179 L |
| 3,680,535 | 8/1972 | Eckert et al. | 123/139 AW |
| 3,713,630 | 1/1973 | Laprade et al. | 123/139 AW |
| 3,777,727 | 12/1973 | Kirchner et al. | 123/179 G |
| 3,927,649 | 12/1975 | Stumpp | 123/139 AW |
| 3,930,479 | 1/1976 | Stumpp | 123/139 AW |
| 3,983,849 | 10/1976 | Stumpp | 123/139 AW |

FOREIGN PATENT DOCUMENTS

| | | | |
|---|---|---|---|
| 1,156,103 | 12/1957 | France | 123/179 L |

*Primary Examiner*—Wendell E. Burns
*Attorney, Agent, or Firm*—Edwin E. Greigg

[57] ABSTRACT

An air valve for a fuel injection system of a mixture-compressing externally ignited internal combustion engine which controlls the air flow in a bypass line associated with the air suction tube, the bypass line bypassing a throttle valve mounted within the suction tube. The air valve includes a membrane which defines a first and second chamber of the valve, the first chamber of which is in communication with atmosphere. The air valve also includes a movable valve component mounted to control the cross-sectional area of the bypass line. The movable valve component is connected to the member by a guide pin, and the movement of the movable valve component is responsive to an arrangement of a guide spring and pressure spring as well as the pressures in the two chambers.

8 Claims, 3 Drawing Figures

AIR VALVE FOR A FUEL INJECTION SYSTEM

BACKGROUND OF THE INVENTION

The invention relates to an air valve for use in an electrically controlled, intermittently operating fuel injection arrangement for internal combustion engines having externally supplied ignition, wherein the apportioned fuel quantity is injected into the suction tube of the intake manifold, within which an air metering member and an arbitrarily manipulatable throttle flap are located in succession, and within which the suction tube sections respectively upstream and downstream of the throttle flap are interconnected via a bypass whose cross-sectional area is variable by means of the air valve. The air valve is provided with a membrane which divides the air valve housing into two chambers in one of which is located a movable valve component that controls the cross-sectional area of the bypass. The valve component is urged toward an open direction by a guide spring, via a connecting member guided by a guide plate.

Air valves which respond, for example, to the pressure drop in the intake manifold resulting from the sudden closing of the throttle valve during over-running operation of the internal combustion engine, in order to influence the fuel-air mixture by delivering a small quantity of air, sufficient to maintain combustion in the individual cylinders of the combustion engine during over-running operation with the throttle valve closed, are well known. This type of air valve is not suitable, however, to enhance the starting condition of the internal combustion engine. Thus, to guarantee reliable and positive starting of the internal combustion engine, it is advantageous to supply the internal combustion engine with two or three times the normal quantity of air, and hence of the fuel-air mixture, needed during idling.

OBJECTS AND SUMMARY OF THE INVENTION

Accordingly, it is a primary object of the present invention to provide an air valve for a fuel injection system of the above-described type, which will assure an improved running of the internal combustion engine during, and immediately subsequent to, the starting of the engine.

This object and others which will become apparent from a consideration of the disclosure that follows are accomplished according to the present invention by providing an air valve having an inner space divided into two chambers by a membrane with one of the chambers communicating freely with the atmosphere, and the other of the chambers communicating with the suction tube section upstream of the throttle valve via a first line and with the suction tube section downstream of the throttle valve via a second line. With this arrangement, the first line is closed by means of a movable valve component, the membrane is acted upon concurrently by a guide spring via the movable valve component, and by a pressure spring located within the second chamber.

According to one advantageous embodiment of the present invention that end of the pressure spring away from the membrane rests upon the guide plate located between the movable valve component and the membrane and the hollow spaces within the second chamber, formed by the guide plate, are in communication via a throttle bore.

According to another advantageous embodiment of the present invention the movable valve component is discshaped.

According to yet another advantageous embodiment of the present invention a central reinforcing disc is associated with the membrane against which a force is exerted by one end of a pressure fin guided within a bore of the guide plate. The other end of the pressure pin pushes against the movable valve component. The bore in the guide plate lies in a hub which is molded or pressed into a central opening in the guide plate.

DESCRIPTION OF THE PREFERRED EMBODIMENTS

Figure 1:
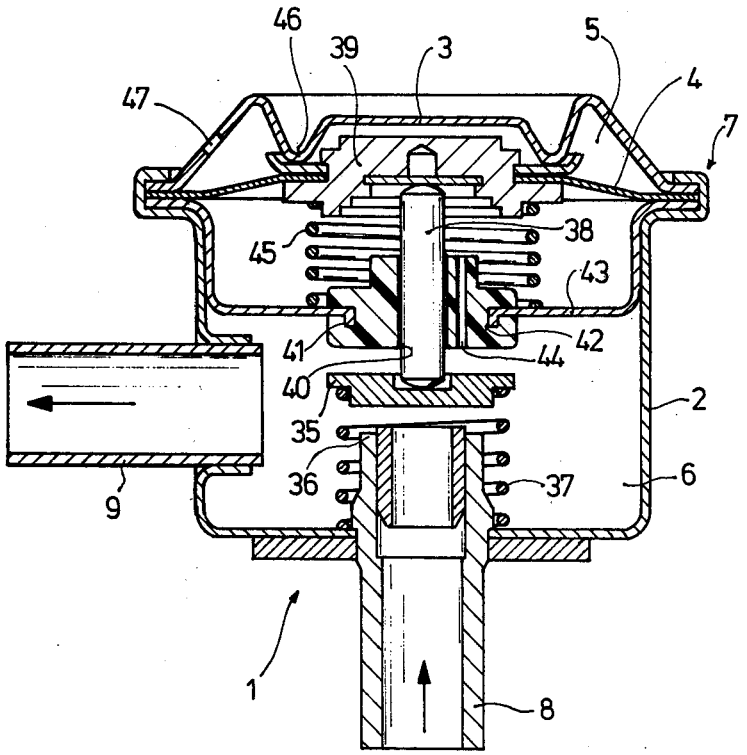
FIG. 1 is a cross-sectional view of the improved air valve.

Turning now to FIG. 1, the air valve, denoted generally at 1 includes complementally formed housing elements 2 and 3, respectively, which when assembled provide a first chamber 5 and a second chamber 6 on opposite sides of a diaphragm 4. The diaphragm 4 is held captive by the double flanged rim 7, which also holds the two housing elements together. Into one side of the chamber 6 is positioned a first conduit 8 which connects, in the manner shown in FIGS. 2 and 3, with a suction tube section upstream of a throttle valve 28, and into the other side there extends a second conduit 9, which connects with a suction tube section downstream of the throttle valve. The second chamber 6 contains a disc-shaped movable valve component 35, which cooperates with a fixed valve seat 36 provided on the upper extremity of conduit 8 and arranged to close the first conduit 8. A guide spring 37 is interposed between the lower wall of chamber 6 and an annular flange on the valve component 35 to urge it into an open position. Between the movable valve component 35 and the diaphragm 4 there is positioned a pressure pin 38, which is movable longitudinally within a close-fitting longitudinal bore 40 of a hub 41 made, for example, of a synthetic material, the hub being affixed to a central opening 42 of a guide plate 43, the structure being so arranged that the pressure pin 38 pushes against a central reinforcing disc 39 to which the diaphragm is secured, as shown. The guide plate 43 is constructed of a die-punched sheet steel, and its flanged rim is secured, together with the diaphragm 4, within the double flanged rim 7. Pressure communication is provided for in chamber 6 on opposite sides of guide plate 43 by means of the aperture 44 in hub 41. In this manner, pressure variations within the chamber 6 may be transmitted to the diaphragm 4 via the throttle opening 44 with a certain time delay, thus achieving a damping of the fluctuations, the primary causes of which are the strong pressure fluctuations attendant to the aspiration process of the internal combustion engine at low engine revolutions per unit time. In addition, the throttle opening 44 assures gentle, smooth transitions between the opened state and the closed state of the air valve without causing it to flutter. Interposed between the guide plate 43 and the reinforcing disc 39 for the diaphragm 4 lies a pressure spring 45, which tends to force the diaphragm 4 toward a circular depression 46 provided in the upper housing element 3.

The first chamber 5 formed by the diaphragm 4 and the housing element 3, communicates with the atmosphere via a bore 47.

The operation of the air valve represented by FIG. 1 is as follows. When the internal combustion engine is not in operation, a pressure of 1 atmosphere is present both in the first chamber 5 and in the second chamber 6 of the air valve 1. Due to the combined spring forces of the guide spring 37 and of the pressure spring 45, the diaphragm 4 is urged upwardly against the circular depression 46 of the housing element 3, and the movable valve component 35 is in its opened position as shown in FIG. 1. When the internal combustion engine is initially cranked for starting, it receives, for the time being, an air quantity two to three times greater, and sufficient to assure a successful starting, via the bypass formed by the opened air valve and conduits 8 and 9. Once the pressure drops in the suction tube, and hence in the chamber 6 via the communicating conduit 9, and reaches a certain value previously predetermined by the choice of the spring forces of the guide spring 37 and of the pressure spring 45, then the closing force of the atmospheric pressure upon the diaphragm 4 in the chamber 5 exceeds the opening force upon the diaphragm 4 effectively resulting from the spring forces 37 and 45 and from the subtractive force of the pressure drop in the chamber 6, thus positioning the movable valve component 35 into the closed direction upon the fixed valve seat 36, and thereby interrupting any further air delivery via the conduits 8 and 9 around the throttle valve. The pressure spring 45 is herein so designed as to bear against the diaphragm 4 with a spring pressure substantially greater than that of the guide spring 37. It is to be understood that the essential purpose of the guide spring 37 is to maintain functional contact between the movable valve component 35 and the diaphragm 4, via the pressure pin 30. A spring of lower capacity, having no significant influence upon the closing pressure, thus adequately suffices to serve herein. An increasing of the spring force of the guide spring 37 would entail decisive disadvantages such as, for example, an increase of the friction at the surfaces of the extremities of the guide spring, undesirable tipping motions of the movable valve component 35 during its opening or closing movement, and increased friction due to any tilting of the pressure pin 38.

Figure 2:
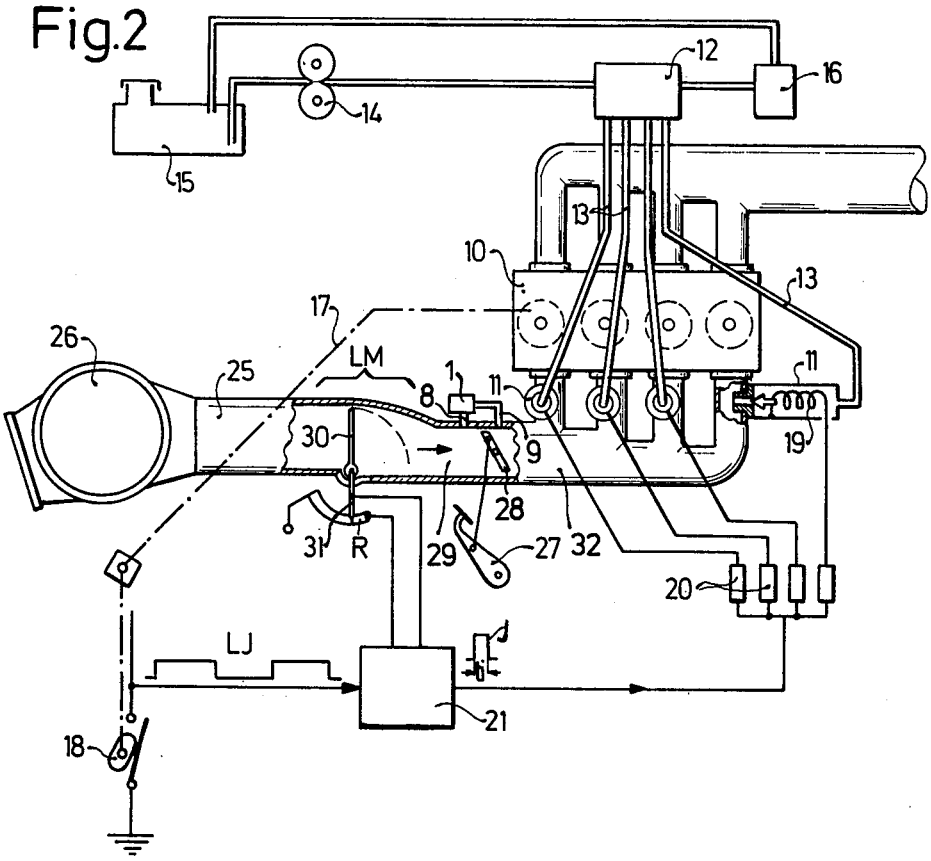
FIG. 2 shows an electrically controlled fuel injection system provided with an air valve.
Figure 3:
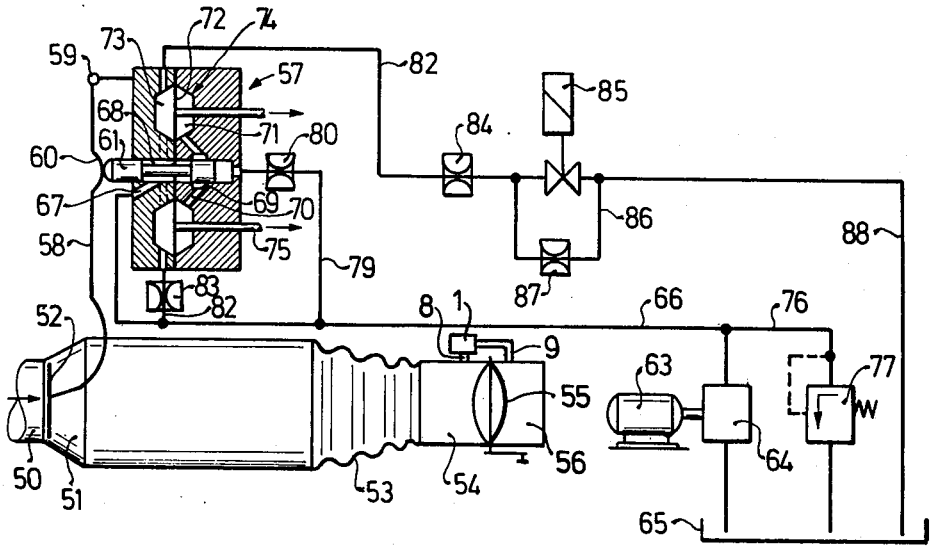
FIG. 3 shows a mechanical fuel injection system provided with an air valve.

FIGS. 2 and 3 depict two examples of the embodiment of the air valve when incorporated into fuel injection systems of the type revealed by earlier patents assigned to the assignee of the present invention, for example, U.S. Pat. No. 3,750,631.

The electrically controlled fuel injection system illustrated in FIG. 2 is intended for use with a four-cylinder, four-stroke internal combustion engine 10, and basically consists of four electromagnetically actuated injection valves 11, to each of which the fuel to be injected is supplied by a distributor 12 via the respective conduit 13 of an electrically driven fuel pump 14. The fuel pump 14 pumps fuel from a fuel tank 15. The fuel is maintained at a constant fuel pressure by a pressure regulator 16. The injection valves 11 are also connected to an electronic controlling and regulating apparatus (to be described), which is triggered twice during each revolution of the engine's camshaft 17 by a signal generator 18 coupled to the camshaft 17. In each case, the apparatus delivers a corresponding square-wave shaped electronical opening pulse J for the injection valves 11. The time duration T*i* of the opening pulses, illustrated in the drawing, determines the duration of the open state of the injection valves and, resultantly, that fuel quantity which leaves the interior of the injection valves 11, wherein an essentially constant pressure of 2 atmospheres is maintained, during the particular given open state duration. The magnetic windings 19 of the injection valves 11 are each connected in series to a respective decoupling resistance 20, and thence connected to a common amplifier driver stage of an electronic control apparatus 21 containing at least one driver transistor whose emitter collector path completes the circuit via the respective series decoupling resistances 20 and the common connection of the magnetic valves 19.

In combustion engines of the depicted type, whose mixture is compressed and whose ignition is externally supplied, that specific fuel quantity is apportioned during each single suction stroke by the aspirated air quantity reaching each cylinder, which can be completely combusted during the subsequent power stroke. To obtain the optimal efficiency from the combustion engine, it is essential that no significant surplus of air remain present after the power stroke. In order to achieve the desired stoichiometer relationship between aspirated air and the fuel, an air quantity metering device LM, comprised essentially of a static plate 30 and a variable resistance R whose adjustable tap is linked to the static plate, is situated in the suction tube 25 of the intake manifold of the engine. The device LM is situated downstream of a filter 26 and upstream of the throttle valve 28. The position of the throttle valve 28 is manipulated by the accelerator pedal 27. The air quantity metering device LM cooperates with the electronic control apparatus 21, whose output-stage delivers the injection pulses T*i*. The electronic control apparatus 21 contains two mutually cross-coupled, and hence alternately conducting feedback transistors, as well as an energy storage device, whose function may be embodied by a capacitor, or alternatively, by an inductor. The duration of the respective given discharging process of the energy storage device yields the opening duration T*i* of the injection valves. To this end, the energy storage device must be charged, prior to each discharge, at a definite rate.

To assure that the given discharge duration contains the needed information regarding the given air quantity corresponding to the respective single suction stroke, the charging process is controlled by a charge switching circuit, represented in the embodiment of FIG. 1 by the signal generator 18. The signal generator 18 is synchronously coupled to the revolving motion of the crankshaft 17, and serves to interconnect the energy storage device with the charging source during the charging pulse LJ, which lasts for and during a fixed, constant angular displacement of the crankshaft. During the charging pulse, the energy storage device delivers a given charging current. It is assumed for the present given case that the signal generator 18, which may in actual application, consist of a bistable multivibrator respectively toggled to its complementary states by the ingition pulses, is switched off for an angular displacement of the crankshaft of 180°, and is successively switched on for an equal angular displacement.

To achieve the enhanced running behavior of the engine 10, during and immediately subsequent to starting, an air valve 1, illustrated in FIG. 1, is situated in the bypass formed by conduits 8 and 9. Accordingly, the first conduit 8 communicates with a suction tube section 29 provided between the static plate 30 and the throttle valve 28, and the second conduit 9 communicates with the suction tube section 32 directly downstream of the throttle valve 28.

The possibility of incorporating the invention in a mechanically controlled fuel injection system is depicted by FIG. 3, wherein the air to be combusted flows in the direction of the arrow into a suction tube 50, past a metering member 52 within a conical section 51. The air then flows through a coupling hose 53 and an induction tube region 54 having an arbitrarily manipulatable throttle valve 55, to one or more cylinders (not shown) of the internal combustion engine. The air flow measuring sensor 52 is a plate oriented transversely to the direction of air flow, the movement of which within the conical section 51 of the suction tube is a nearly linear function of the air quantity flowing through the suction tube; whereby, for a constant restoring force acting upon the flow measuring sensor 52, as well as a constant air pressure directly upstream of the sensor 52, the pressure prevalent between the sensor 52 and the throttle flap 55 likewise remains constant.

The air flow measuring sensor 52 directly controls a fuel metering and distributing valve 57. A lever 58, pivotable about a fulcrum bearing 59, is connected with the sensor 52, and serves to transmit the pivotal motion of the sensor 52 via a nose 60 to a movable valve component, constructed as a control slide 61 of the fuel metering and distributing valve 57.

Fuel is supplied by a fuel pump 64, driven by an electric motor 63, from a fuel tank 65 and is delivered through a fuel supply line 66 and a channel 67 to an annular groove 68 on the control slide 61. Depending on the position of the control slide 61, the annular groove 68 opens, to a greater or lesser extent, control slits 69, each of which leads through a channel 70 to a chamber 71. Each chamber 71 is separated from a chamber 73 by a diaphragm 72 which serves as the movable part of a flat seat valve acting as a pressure equalizing valve. From the chamber 71, the fuel is admitted through injection channels 75 to the individual fuel injection valves (not shown) which are located in the induction tube in the vicinity of the engine cylinders.

From the fuel supply line 76 extends a line 66 in which is disposed a pressure limiting valve 77. When there is excessive pressure in the system, the pressure limiting valve allows fuel to flow back into the fuel tank 65.

The face of the control slide 61 remote from the lever 58 is exposed to the force of pressurized fluid which provides a restoring force for the sensor 52 and which exerts its force through a line 69 including a damping throttle 80.

Also extending from the line 76 is a line 82 including, in series, a decoupling throttle 83, the chambers 73 of the pressure equalizing valves 74, a first throttle 84 and an electromagnetic valve 85. Connected in parallel to the electromagnetic valve 85 is a line 86 containing a second throttle 87 through which the fuel in the control pressure circuit 82 may return to the fuel tank without gauge pressure via the return flow line 88.

To enhance the running behavior of the engine during and immediately subsequent to starting, an air valve 1, like that in FIG. 1, is situated in the bypass formed by lines 8 and 9, thus creating communication between the suction tube sections 54 and 56, whenever the air valve is open.

The apparatus shown in FIG. 3 operates as follows:

When the internal combustion engine is running, air is drawn through the induction tube 50, 53 and 54 and, as a result, the sensor 52 is displaced from its rest position. In response to the deflection of the sensor 52, the control slide 61 of the fuel metering and distributing valve 57, which meters the quantity of fuel flowing to the injection valves, is displaced by the lever 58. The direct, positive coupling between the sensor 52 and the control slide 61 insures a constant ratio of the quantity of air to the metered out quantity of fuel.

To maintain a respectively richer or leaner fuel-air mixture according to any given particular operating condition of the engine, it is required to vary the proportionality between the aspired air quantity and the metered fuel quantity as a function of known operational parameters of the engine. The varying of the fuel-air mixture can be accomplished either by varying the restoring force acting upon the sensor 52, or by varying the pressure differential at the metering valve 68, 69. For engines possessing several engine cylinders, it is advantageous to construct the valves 74 in the fuel metering and distributing valve 57 in the form of pressure equalizing valves. The differential pressure at the metering valves 68, 69 may be advantageously varied and regulated concurrently, by means of the pressure in a control pressure line 82. In the illustrated exemplary embodiment, the changing of the differential pressure at the metering valves 68, 69 results from the changing of the differential pressure at a decoupling throttle 83, wherein the quantity of fluid flowing through the decoupling throttle 83 is variable. The varying of the throughflow of the decoupling throttle 83 is accomplished by inserting into the control pressure circuit path 82 a subsequent throttle 84 and a magnetic valve 85 having a parallel throttle 87. When the magnetic valve 85 is closed, the fuel quantity flowing through the decoupling throttle 83 is determined by the throttles 83, 84, and 87. The quantity of fuel flowing in the control pressure circuit path when the magnetic valve is open is then determined only by the throttles 83 and 84, which fact results in a decreased throttling and in an increased pressure differential at the decoupling throttle 83, thus also increasing the pressure differential at the metering valves 68, 69. The modulation of the differential pressure at the decoupling throttle 83 is achieved by varying the relationship between the open state duration and the closed state duration of the magnetic valve 85, whereby a continuously closed magnetic valve yields a lesser pressure differential and a lean fuel-air mixture; whereas a continuously open magnetic valve 85 yields the greatest pressure differential and the richest fuel-air mixture.

Thus, from the foregoing it will also be understood that the given open or closed state of the electromagnetic valve 85 is similarly determined, as depicted in FIG. 2, by an electronic control apparatus (not shown) which may receive, in addition to the known operational parameters of the combustion engine supplied by the respective probes, the output signals of an oxygen sensor.

What is claimed is:

1. An air valve for a fuel injection system of a mixture-compressing externally ignited internal combustion engine, the system comprising: a suction tube into which fuel is injected and within which an air metering member and an arbitrarily displaceable throttle valve are mounted in succession in the direction of air flow; and a bypass line connecting together the sections of the suction tube upstream and downstream of the throttle valve, wherein the cross section of the bypass line is varied by means of an air valve, the air valve comprising:

a. a housing;

b. a membrane within the housing and dividing the space within the housing into a first and second chamber;

c. a movable valve component mounted to control the cross-sectional area of the bypass;

d. a guide plate;

e. a connecting member guided by the guide plate and connecting the membrane to the movable valve component;

f. a guide spring mounted to bias the movable valve component in an open direction;

g. a first line; and h. pressure spring situated in the second chamber, wherein:

i. the first chamber communicates with atmosphere;

ii. the second chamber communicates with the suction tube section upstream of the throttle valve via the first line;

iii. the first line is closable by the movable valve component; and iv. the membrane is concurrently acted upon by the guide spring via the movable valve component and by the pressure spring.

2. The air valve as defined in claim 1, wherein the pressure spring rests with one of its ends against the guide plate, and wherein the guide plate is located between the membrane and the movable valve component.

3. The air valve as defined in claim 2, further comprising:

i. a throttle bore, wherein the guide plate separates the second chamber into two spaces which are in communication via the throttle bore.

4. The air valve as defined in claim 1, wherein the movable valve component is disc-shaped.

5. The air valve as defined in claim 1, further comprising:

i. a central reinforcing disc; and j. a pressure pin, wherein:

v. the membrane is mounted to the central reinforcing disc upon which one end of the pressure pin acts;

vi. the guide plate includes a guide bore which serves to guide the pressure pin in its motion; and vii. the other end of the pressure pin acts against the movable valve component.

6. The air valve as defined in claim 5, further comprising:

k. a hub, wherein:

viii. the guide plate includes a central opening;

ix. the hub is molded into the central opening; and x. the guide bore is located within the hub.

7. The air valve as defined in claim 5, further comprising:

k. a hub, wherein:

viii. the guide plate includes a central opening;

ix. the hub is pressed into the central opening; and x. the guide bore is located within the hub.

8. The air valve as defined in claim 1, wherein the force of the pressure spring on the membrane is greater than the force of the guide spring.

* * * * *